United States Patent [19]

Asami et al.

[11] Patent Number: 4,518,330

[45] Date of Patent: May 21, 1985

[54] ROTARY COMPRESSOR WITH HEAT EXCHANGER

[75] Inventors: Kazutomo Asami; Fumio Wada; Koji Ishijima; Yutaka Sato, all of Shizuoka, Japan

[73] Assignee: Mitsubishi Denki Kabushiki Kaisha, Tokyo, Japan

[21] Appl. No.: 519,760

[22] Filed: Aug. 2, 1983

[30] Foreign Application Priority Data

| | | | |
|---|---|---|---|
| Aug. 30, 1982 | [JP] | Japan | 57-150319 |
| Sep. 30, 1982 | [JP] | Japan | 57-148473[U] |
| Sep. 30, 1982 | [JP] | Japan | 57-148474[U] |
| Oct. 19, 1982 | [JP] | Japan | 57-157697[U] |
| Nov. 19, 1982 | [JP] | Japan | 57-175278[U] |

[51] Int. Cl.[3] ..... F04C 18/00; F04C 29/04; F04B 23/04

[52] U.S. Cl. ..... 418/63; 418/85; 418/88; 417/76; 417/313; 417/902; 62/469

[58] Field of Search ..... 417/76, 87, 313, 368, 417/372, 373, 410, 902; 418/88, 63, 83, 85; 62/469; 184/6.16

[56] References Cited

U.S. PATENT DOCUMENTS

| | | | |
|---|---|---|---|
| 1,967,035 | 7/1934 | Lipman | 417/902 X |
| 2,178,425 | 10/1939 | Johnson | 417/372 X |
| 2,623,365 | 12/1952 | Daniel | 62/469 |
| 3,015,222 | 1/1962 | Wellborn et al. | 62/469 X |
| 3,422,635 | 1/1969 | Trenkowitz | 62/469 |
| 3,548,612 | 12/1970 | Mitsubayashi et al. | 62/469 |
| 3,746,477 | 7/1973 | Ozu et al. | 417/372 |
| 4,355,963 | 10/1982 | Tanaka et al. | 417/902 X |

FOREIGN PATENT DOCUMENTS

| | | | |
|---|---|---|---|
| 123391 | 9/1980 | Japan | 418/85 |
| 168084 | 10/1982 | Japan | 418/88 |

*Primary Examiner*—William L. Freeh
*Assistant Examiner*—Paul F. Neils
*Attorney, Agent, or Firm*—Oblon, Fisher, Spivak, McClelland & Maier

[57] ABSTRACT

A rotary compressor comprises a compression chamber defined by enclosing both ends of a cylinder with a main bearing and an end bearing; compression elements including a piston which is eccentrically rotated by a crank shaft within the compression chamber, and dividing the compression chamber into a high pressure chamber and a low pressure chamber; and a sealed container to be a plenum space, in which the compression elements are housed and lubricating oil is sumped at the inner bottom section of the sealed container to effect lubrication of sliding parts of the compression elements, wherein the lubricating oil is returned into the sealed container after it has been cooled through a heat-exchanger provided outside the sealed container.

3 Claims, 12 Drawing Figures

ROTARY COMPRESSOR WITH HEAT EXCHANGER

This invention relates to a rotary compressor, and, more particularly, it is concerned with the rotary compressor of a type, in which lubricating oil is cooled by a heat-exchanger for improving the performance and reliability in its operation.

In the conventional compressing machine, particularly, in a compressor of a large capacity, there is an increase in quantity of heat to be generated from various compressing elements in it, whereas quantity of heat to be dispersed does not increase correspondingly, with the consequence that the temperature of the compressing machine as a whole goes up. On account of this, there take place not only preheating of intake gas, deterioration in sealing against leakage of lubricating oil, lowering in operating efficiency of electric motor, etc. to thereby cause decrease in the operational performance of the compressor, but also lowering of the film sustaining force of the lubricating oil, deterioration in the insulating material for the electric motor, etc., all of which resulted in decrease in operational reliability of the machine.

Therefore, with a view to increasing the discharging quantity of heat from the compressor, there have been employed various means such as an oil cooler, and so forth. In the conventional oil cooler, however, since a part of its coolant circuit is drawn into a tightly sealed container, tubing and assembly in the sealed container interior and at the side of a unit using such compressor becomes complicated resulting in increased manufacturing cost.

The present invention aims at improving those disadvantages inherent in the conventional compressor so as to provide such a compressing machine which can be assembled readily and has excellent operational performance and reliability.

It is another object of the present invention to provide a compressor with its performance being improved by cooling the lubricating oil in the compressor through a heat-exchanger installed outside the sealed container, and, after cooling, returning the same into the sealed container.

It is other object of the present invention to provide an improved compressor of a construction, in which the lubricating oil is forwarded to a heat-exchanger by use of pressure exerted at the time of discharging the coolant gas.

According to one aspect of the present invention, there is provided a rotary compressor which comprises: a compression chamber defined by enclosing both ends of a cylinder with a main bearing and an end bearing; compression elements including a piston which is eccentrically rotated by a crank shaft within the compression chamber, and dividing the compression chamber into a high pressure chamber and a low pressure chamber; and a sealed container to form a plenum space, in which the compression elements are housed and lubricating oil is sumped at the inner bottom section of the sealed container to effect lubrication of sliding parts of the compression elements, wherein the lubricating oil is returned into the sealed container after it has been cooled through a heat-exchanger provided outside the sealed container.

According to another aspect of the present invention, there is provided a horizontal type rotary compressor, which comprises: a compression chamber defined by enclosing both ends of a cylinder with a main bearing and an end bearing; compression elements including a piston which is eccentrically rotated by a crank shaft within the compression chamber, and dividing the compression chamber into a high pressure chamber and a low pressure chamber; and a sealed container to form a plenum space, in which the compression elements are housed and lubricating oil is sumped at the inner bottom section of the sealed container to perform lubrication of sliding parts of the compression elements, wherein there are further provided a communicating port formed in said cylinder so as to introduce discharged coolant gas from the compression chamber; a large diameter section of said communicating port, which is expanded in the lubricating oil; an ejecting pipe, one end of which is inserted into said communicating port and opened in said large diameter section thereof; and an oil inducing path which intersects orthogonally with said large diameter section and passes through said cylinder, the lubricating oil being let out of said oil inducing path, being caused to pass through a heat-exchanger provided outside said sealed container together with the discharged gas, and being returned into the sealed container.

The foregoing objects, other objects as well as the specific construction and functions of the rotary compressor according to the present invention will become more apparent and understandable from the following detailed description of several preferred embodiments thereof, when read in conjunction with the accompanying drawing.

Figure 1:
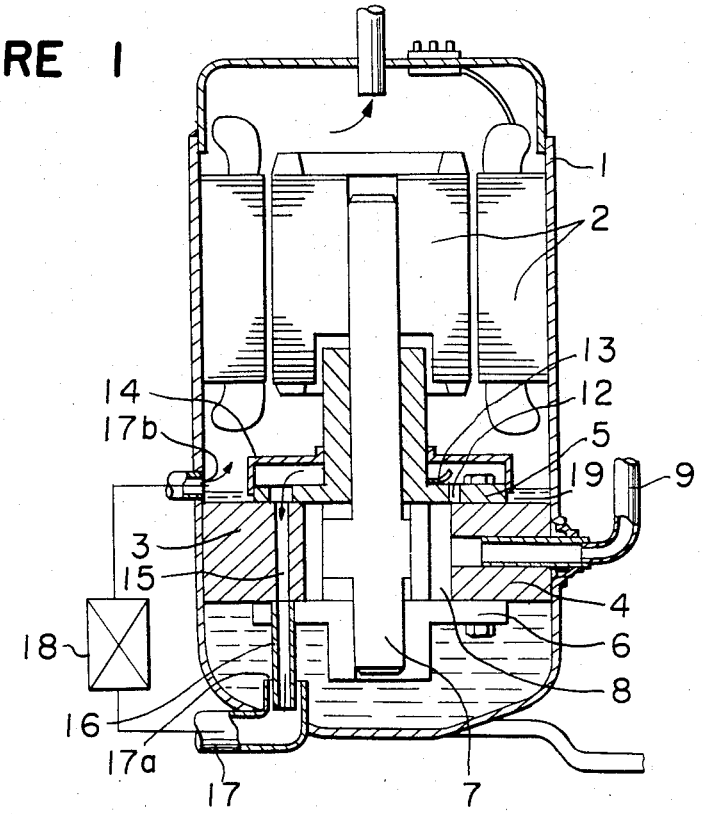
FIG. 1 is a cross-sectional view of the first embodiment of the rotary compressor according to the present invention.
Figure 2:
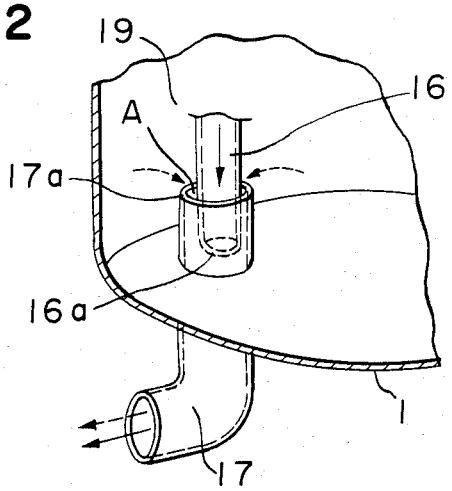
FIG. 2 is a perspective view showing the main part of the rotary compressor of FIG. 1, which is partly cut out.

In the following, the present invention will be described in specific details in reference to FIGS. 1 and 2 showing the first preferred embodiment of thereof.

FIG. 1 is a cross-sectional view of the rotary compressor according to the first embodiment of the present invention, and FIG. 2 is a perspective view of the main part of the rotary compressor according to the first embodiment of the present invention. In the drawing, a reference numeral 1 designates a hermetically sealed container; numerals 2 and 3 refer respectively to an electric motor and compressor elements housed in the hermetically sealed container; and numeral 7 refers to a crank shaft to be driven by the electric motor 2, and others. The above-mentioned compression elements 3 comprise a piston 8 fitted on the crank shaft, a vane (not shown in the drawing) with its one end being in contact with the piston and performing reciprocating motion, main and end bearings 5, 6 support the above-mentioned crank shaft 7, and a cylinder 4 provided in between the two bearings. The interior of this cylinder is divided by the above-mentioned vane, as is well known, into a high pressure chamber and a low pressure chamber for the coolant so that suction and discharge of the coolant can be repeated by the eccentric rotation of the crank shaft 7.

The coolant gas compressed in the above-described manner passes through a discharge port 12 and a discharge valve 13 formed in and provided on the main bearing 5, and discharged into a silencing chamber 14 provided at the outside of the main bearing to the discharge side of the coolant. A numeral 15 refers to a gas passage hole through the cylinder 4 between the main bearing 5 and the end bearing 6. A reference numeral 16 denotes a gas discharge tube with its fixed end being inserted into this gas passage hole, the other end of the gas discharge tube being a gas discharging end portion 16*a* which is opened in an oil guiding tube 17, one end of which is also opened in the lubricating oil 19 sumped in the hermetically sealed container 1. This oil guiding tube (or oil feeding tube) 17 is opened, at the other end thereof, in the sealed container through a heat-exchanger 18 provided at the outside thereof. As the consequence of this, the discharged gas from the compression chamber is led into a lubricating oil feeding end 17*a* of the oil feeding tube 17 through the discharge end portion 16*a* of the gas discharge tube 16. In this case, the lubricating oil 19 standing at the bottom part of the sealed container 1 is drawn into the oil feeding tube 17 through a gap A formed in an overlapped portion between the gas discharge tube and the oil feeding tube, is forwarded to the heat-exchanger 18 provided outside the sealed container together with an ejected gas from the gas discharge tube, and is fed back into the sealed container 1 again through a feeding end portion 17*b*.

In the first embodiment of the rotary compressor according to the present invention is constructed as mentioned in the foregoing, the lubricating oil at the inner bottom part of the sealed container circulates in the oil feeding tube, while discharging heat, whereby it keeps discharging heat transmitted from the electric motor, the compression elements, and so on. In this manner, the temperature of the compressor as a whole inclusive of the compression elements, the lubricating oil, and so on is lowered with the consequence that not only the performance of the compressor improves due to inhibition against preheating of the intake gas, improvement in sealing against leakage of the lubricating oil, etc., but also reliability of the device such as improvement in the lubricating property, etc. becomes effectively augmented.

Figure 3:
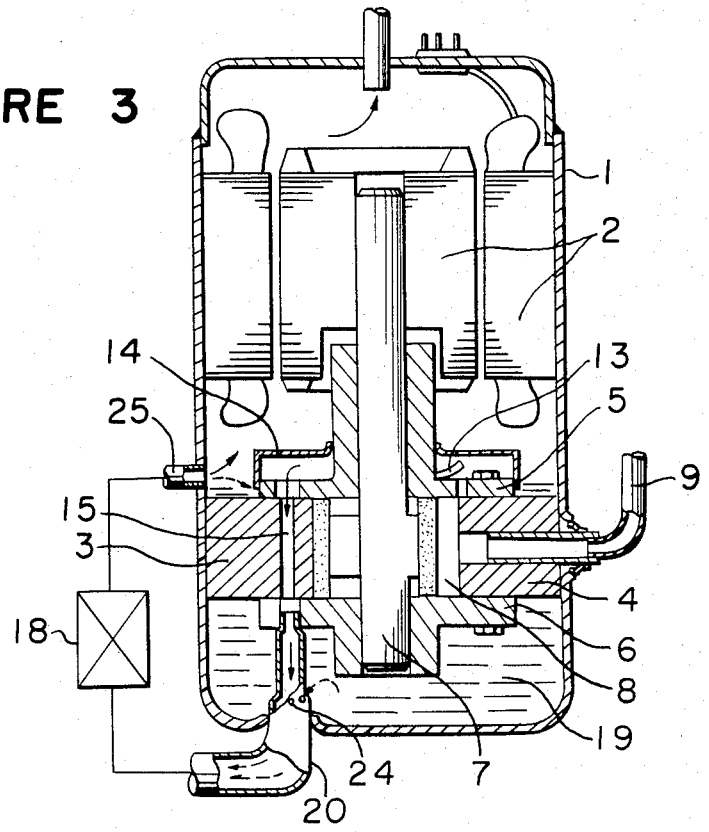
FIG. 3 is a cross-sectional view of the second embodiment of the rotary compressor according to the present invention, in which a device for cooling the lubricating oil is provided.
Figure 4:
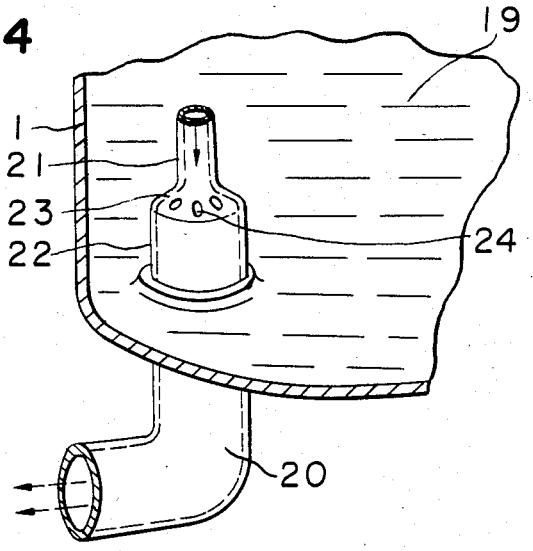
FIG. 4 is a perspective view showing the main part of the rotary compressor of FIG. 3, which is partly cut out.

In the following, the second embodiment of the present invention will be explained in detail in reference to FIGS. 3 and 4. It should be noted that, in the drawing, those parts which are same with or similar to those in the FIG. 1 embodiment will be designated by the same reference numerals. In this embodiment of the invention, the rotary compressor performs its operation in the manner to be described in the following.

The coolant gas as drawn in from the intake tube 9 is compressed by the piston 8 which rotates eccentrically in the cylinder 4. The thus compressed coolant gas passes through the outlet valve 13 provided on the main bearing 5 to be discharged into the silencing chamber 14, further passes through the gas passage hole 15 through the main and end bearings 5, 6 and the cylinder 4 therebetween, and is led into a connecting tube 20, one end of which is joined with the gas passage hole. This connecting tube for leading the discharged gas is expanded its diameter in the lubricating oil 19 standing at the inner bottom part of the sealed container 1. Small holes 24 for sucking the lubricating oil are formed in the vicinity of a stepped part 23 between the small diameter part 21 and the large diameter part 22 of the connecting tube 20. The other end of this connecting tube 20 is led to the heat-exchanger 18 installed outside the sealed container 1 by way of the bottom part thereof, and is again connected with another connecting tube 25 which is again opened in the sealed container 1 after the heat-exchange with the outside air.

Accordingly, the compressed coolant gas which has been led into the connecting tube 20 through the gas passage hole 15 is further led to the heat-exchanger 18 provided outside the sealed container 1 together with the lubricating oil 19 which has been drawn into the connecting tube through the small holes 24 which are opened at the stepped part of the connecting tube and for sucking the lubricating oil, and then is sent into the sealed container 1 again through the connecting tube 25 for the heat-exchanger 18. This is to say, owing to the lubricating oil 19 repeating its circulation together with the compressed coolant gas, while discharging heat therefrom, the heat generated from the electric motor 2 and the compression elements 3 is constantly kept discharged outside. In this manner, the temperature in the electric motor element 2, the compression elements 3, the lubricating oil 19, and so forth can be lowered, whereby the temperature of the compressor as a whole can be decreased. As the result of this, the performance of the compressor improves due to inhibition against preheating of the intake gas, improvement in sealing against leakage of the lubricating oil, improvement in the operating efficiency of the motor, and so forth, and the reliability of the compressor also improves due to inhibition against deterioration of the insulating material for the electric motor.

Figure 5:
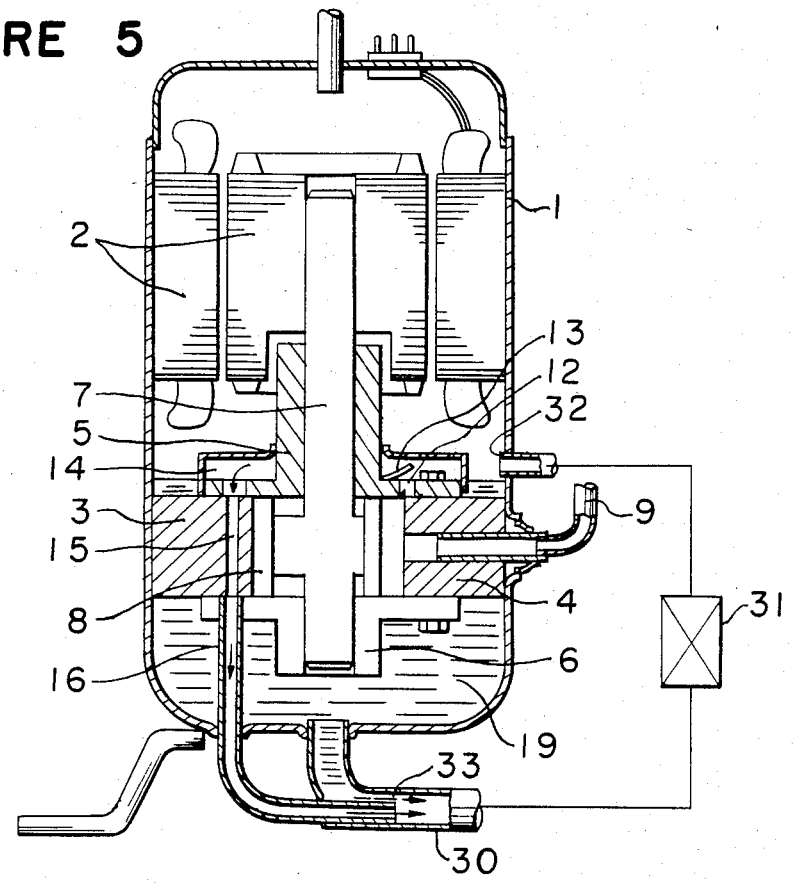
FIG. 5 is a cross-sectional view of the third embodiment of the rotary compressor according to the present invention, in which a lubricating oil cooling circuit is provided.
Figure 6:
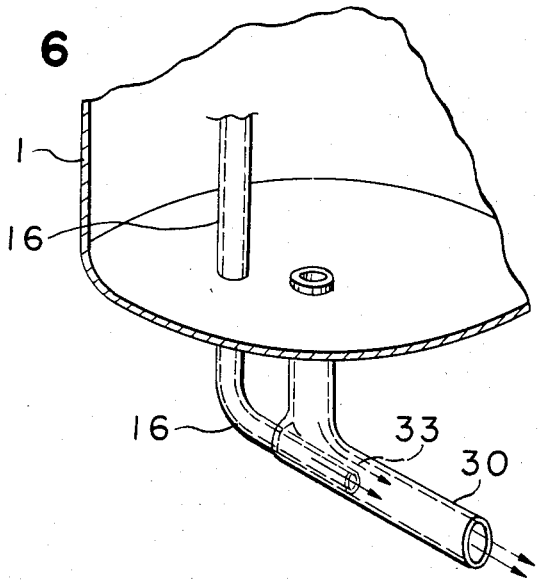
FIG. 6 is a perspective view, partly cut out, of the main part of the rotary compressor according to the present invention.

In the following, the third embodiment of the present invention will be explained in reference to FIGS. 5 and 6. It should be noted that, in the drawing, those parts which are same as or similar to those as shown in FIG. 1 are designated by the same reference numerals. In this embodiment, the rotary compressor performs its operation in the manner to be described as follows.

The coolant gas which has been drawn in from the intake tube 9 and compressed passes through the discharge port 12 and the discharge valve 13 formed in and provided on the main bearing 5, and discharged into the silencing chamber 14 at the discharge side, after which it further passes through the gas passage hole 15 through the main and end bearings 5, 6 and the cylinder 4 therebetween, and then is led into gas discharge tube 16, the fixed end of which is inserted into the gas passage hole. A reference numeral 30 designates an oil feeding tube, one end of which is opened to the collecting section for the lubricating oil 19 in the above-mentioned sealed container 1; a numeral 31 refers to the heat-exchanger for cooling the lubricating oil, which is provided outside the sealed container; and a numeral 32 denotes the connecting tube which is opened to the side wall of the sealed container 1 so as to be communicating with the upper space of the cylinder 4. This connecting tube is connected in series with the heat-exchanger 31 and the oil feeding tube 30, the other end of the above-mentioned gas discharging tube 16 being opened into this oil feeding tube 30.

Accordingly, the compressed coolant gas from the compression chamber is discharged into the oil feeding tube 30 from the end part of the gas discharge tube 30. The lubricating oil standing at the bottom part of the sealed container 1 is sucked into the discharge tube 16 through a gap 33 formed in the overlapped section between the discharge tube 16 and the oil feeding tube 30, which passes through the heat-exchanger 31 provided outside the sealed container 1, and is again sent into the sealed container.

As mentioned in the foregoing, the third embodiment of the present invention causes the lubricating oil to circulate, while discharging heat through the heat-exchanger. By discharging heat to be transmitted from the compression elements and the electric motor, and so forth, the temperature in the compression elements, the electric motor element, further the lubricating oil, and so forth becomes lowered, hence the temperature of the compressor as a whole can be decreased, and also the performance of the compressor can be improved due to inhibition against preheating of the intake gas, improvement in sealing against leakage of the lubricating oil, improvement in working efficiency of the electric motor, and others. Furthermore, reliability of the compressor can be remarkably improved as the result of improvement in the lubricating performance, inhibition against deterioration in the insulating material for the electric motor elements, and so forth. p Moreover, by providing a member, at which the gas discharge tube and the oil feeding tube are joined, at a position outside the sealed container, the internal space of the compressor can be reduced, which contributes to realizing reduction in size of the compressor.

Figure 7:
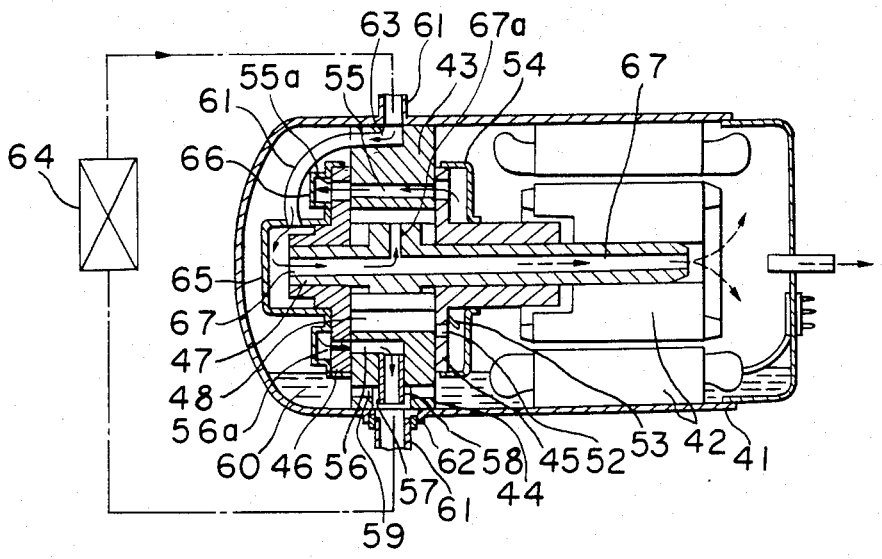
FIG. 7 is a cross-sectional view of the fourth embodiment of the rotary compressor according to the present invention.
Figure 8A:
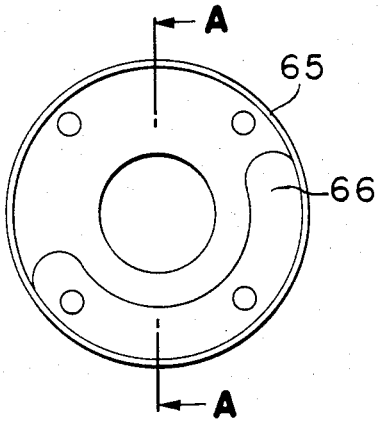
FIG. 8A is a plan view of an oil sump in the rotary compressor shown in FIG. 7.
Figure 8B:
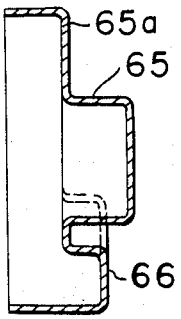
FIG. 8B is a cross-sectional view of the oil sump shown in FIG. 8A, taken along the line A—A in FIG. 8A.

In the following, the fourth embodiment of the present invention will be explained in reference to FIG. 7 illustrating a horizontal type rotary compressor. In FIG. 7, a reference numeral 41 designates the sealed container; numerals 42, 43 respectively refer to the electric motor section and the compression elements housed in the sealed container; and a numeral 47 refers to the crank shaft to be driven by the electric motor section 42, etc., which is disposed in the horizontal direction. The compression elements 43 comprise the piston 48 fitted onto the crank shaft, the vane (not shown in the drawing) with its one end being in contact with the piston, and which performs its reciprocating motion, the main and end bearings 45, 46 to support the crank shaft 47, and the cylinder 44 positioned between the two bearings. The interior of this cylinder is divided, as is well known, by the above-mentioned vane into the high pressure chamber and the low pressure chamber so that the inlet and outlet of the coolant may be repeated by the eccentric rotation of the crank shaft 47.

The coolant gas which has been compressed in the abovementioned manner passes through the discharging valve 53 provided on the main bearing 45, and is discharged into the silencing chamber 54 at its discharge side provided outside the main bearing 45. A reference numeral 55 denotes the gas passage hole through the main and end bearings 45, 46 and the cylinder 44 disposed between them.

A reference numeral 56 designates a communicating port which is formed through in such a manner that one end of it is open to the lower surface of the cylinder 44, and the other end thereof is open at a position away from the open end 55*a* of the gas passage hole which is open to the above-mentioned end bearing 46. This communicating port has a large diameter section 57 in the vicinity of the lower end of the cylinder where its diameter is expanded. A reference numeral 58 indicates an ejecting pipe with its one end being inserted into this communicating port and with its other end being opened in the large diameter section 57 contiguous to the sealed container 41. This ejecting pipe forms a space gap between its outer periphery and the large diameter section. A numeral 59 refers to an oil inducing path which passes through the cylinder 44 interior so as to be opposed to the side surface of the ejecting pipe 58. This oil inducing path is opened in the lubricating oil 60 standing at the inner bottom part of the sealed container 41.

A reference numeral 61 designates an oil feeding pipe, one end of which is connected with a bar ring 62 opened to the lower surface wall of the sealed container 41 in opposition to the above-mentioned large diameter section 57, and the other end of which is connected with the oil feeding path 63 provided in the cylinder 43 passing through the upper surface wall of the sealed container 41. A numeral 64 refers to the heat-exchanger which is connected intermediate of the oil feeding pipe, and provided outside the sealed container. A numeral 65 refers to an oil sump vessel in a substantially cup-shape having an oil sump section between the end surfaces of the end bearing 46. The oil sump vessel has a flange portion 65*a* to fit on the outer surface of the end bearing 46, and forms a gas flow path 66 by bulging out the above-mentioned flange portion 65*a* in a manner as to connect the open end of the gas passage hole 55*a* in the end bearing 46 and the open end 56*a* of the communicating port. Moreover, these oil sump vessel 65 and the oil feeding pipe 63 are connected by the oil feeding pipe 61. By the way, a reference numeral 67 denotes an oil feeding port passing concentrically through the above-mentioned crank shaft 47. By this oil feeding port, oil is fed to the sliding parts through a branch port 67*a*.

On account of such construction, the discharged gas from the compression chamber passes through the silencing chamber 54 at the discharge side thereof and the gas passage hole 55, and is led into the ejecting pipe 58 in the communicating port through the gas flow path formed in the above-mentioned oil sump vessel 65. Then, the gas ejected at the large diameter section 57 is forwarded to the heat-exchanger 64 outside the sealed container together with oil drawn into the large diameter section through the gap formed between the ejecting pipe and the large diameter section to be cooled, after which it is returned to the sealed container 41, wherein the oil is sent to the oil sump vessel 65 through the oil guiding path 63 and the oil feeding pipe 61, after which it is distributed to all of the sliding parts, while the coolant gas is discharged into the sealed container 41 from the end surface of the crank shaft 47 at the side of the electric motor.

As described in the foregoing, according to this fourth embodiment of the present invention, the lubricating oil at the inner bottom part of the sealed container circulates, while discharging heat, whereby it continues to discharge heat to be transmitted from the electric motor section, the compression elements, and others. In this way, the temperature of the compression elements, the lubricating oil, etc., hence the temperature of the compressor as a whole, is lowered. On account of this, not only the performance of the compressor improves due to inhibition against preheating of the intake gas, improvements in the sealing property of the lubricating oil, etc., but also the effect to reliability of the operation of the device such as improvement in the lubricating performance, etc. is also great.

Figure 9:
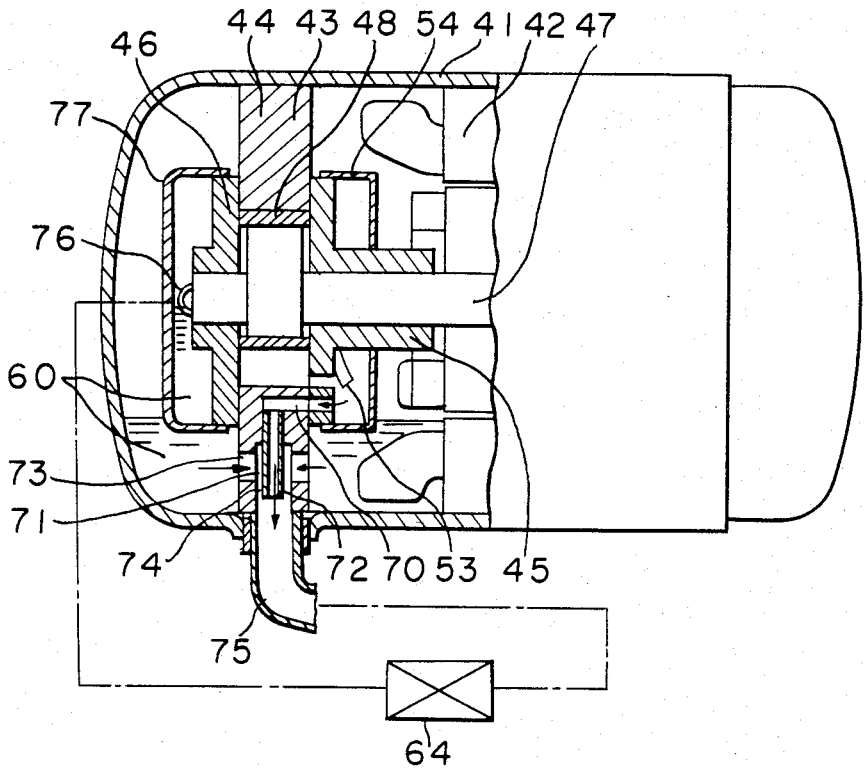
FIG. 9 is a side elevational view, partly cut away, of the fifth embodiment of the rotary compressor according to the present invention.
Figure 10A:
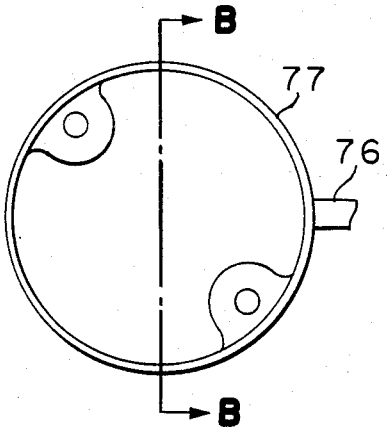
FIG. 10A is a plan view of the oil sump in the rotary compressor shown in FIG. 9.
Figure 10B:
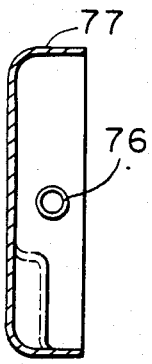
FIG. 10B is a cross-sectional view of the oil sump shown in FIG. 10A, taken along the line B B in FIG. 10A.

In the following, the fifth embodiment of the rotary compressor according to the present invention is explained in reference to FIG. 9. It should be noted that, in the drawing, those parts which are identical with or similar to those in the FIG. 7 embodiment are designated by the same reference numerals. In FIG. 9, a reference numeral 70 is designated by the gas passage hole which passes through the main bearing 45 at a position close to the discharge valve 53 and through the cylinder 44 in a shape of a letter "L", and is opened toward the lower surface of the cylinder in its radial direction. This gas passage hole is joined with the communicating port 71 of a large diameter.

A reference numeral 72 denotes the ejecting pipe with its one end being press-fitted into the small diameter part of the communicating port. The other end of this ejecting pipe 72 is opened in the large diameter part of the communicating port 71 in the neighborhood of the entrance into the heat-exchanger installed outside the sealed container. A numeral 73 refers to the oil inducing path opened in the cylinder immersed in the lubricating oil 60 at the bottom part of the sealed container so as to intersect orthogonally with the large diameter part of the communicating port 71. This oil inducing path is communicatively connected with the gap 74 between the inner diameter part of the communicating port 71 and the outer diameter part of the ejecting pipe 72. Incidentally, the external heat-exchanger 64 for cooling the lubricating oil is connected with the large diameter part of the communicating port 71 at the outer peripheral part of the cylinder through the pipe 75. The other end of the heat-exchanger 64 is communicatively connected with the substantially cup-shaped oil sump vessel 77 which has been press-fitted on the outer periphery of the flanged part of the end bearing 46 through the oil guiding pipe 76 passing through the sealed container 41, whereby the lubricating oil in this oil sump vessel is distributed to each of the sliding parts through the oil feeding ports (not shown in the drawing) opened in the above-mentioned crank shaft 47. Further, the outer peripheral part of this oil sump vessel is press-fitted in and fixed on the flange portion of the end bearing 46.

Accordingly, the discharged coolant gas from the compression chamber passes through the silencing chamber 54 at the discharge side and the gas passage hole 70, and is ejected from the above-mentioned ejecting pipe 72 within the entrance portion of the heat-exchanger, i.e., within the large diameter portion of the communicating port 71. Then, it is sent into the heat-exchanger 64 provided outside the sealed container together with the lubricating oil 60 drawn thereinto through the space gap 74 at the overlapped portion between the inner diameter portion of the communicating port 71 and the outer diameter portion of the ejecting pipe 72. After the heat-exchange, the gas is sent back into the sealed container again. On the other hand, the lubricating oil is sent back into the above-mentioned substantially cup-shaped oil sump vessel 77 through the oil guiding pipe 76 in the sealed container. After this, the lubricating oil is distributed to each of the sliding parts, while the coolant gas is discharged into the sealed container from the end surface of the crank shaft 47 at the side of the electric motor.

Since the fifth embodiment of the rotaty compressor according to the present invention is constructed as described in the foregoing, the lubricating oil at the inner bottom part of the sealed container circulates, while discharging heat, whereby it continues to discharge heat to be transmitted from the electric motor section, the compression elements, and others. In this way, since the temperature of the compressor as a whole including the compression elements, the lubricating oil, and so on is lowered, not only the performance of the compressor improves due to inhibition against preheating of the intake gas, improvement in the sealing property against leakage of the lubricating oil, and so forth, but also the effect to reliability of the compressor such as improvement in the lubricating performance, etc. is also great. Further, with such construction as in the present invention, the compressor can be installed either in the horizontal direction or in the vertical direction, whereby the best mode of its use with good space saving installation can be expected.

What is claimed is:

1. A rotary compressor comprising:

a sealed container defining a plenum;

a crankshaft rotatable in said sealed container about a rotary axis;

a main rotary bearing and an end rotary bearing for said crankshaft;

compression means including an eccentric piston rotated by said crankshaft, said compression means and said bearing together defining a portion of a compression chamber including high and low pressure chamber portions;

means for positioning said container so as to define a plenum bottom;

an oil sump in said plenum bottom, said sump including oil for lubricating at least one of said bearings;

means for introducing gas to be compressed into said low pressure chamber portion;

an oil feeding tube extending outside of said container and having one end in fluid communication with said plenum at a position above said sump and a second end inserted in said plenum bottom and in fluid communication with said oil in said sump;

a heat exchanger positioned in line in said oil feeding tube and outside of said container for cooling fluid passing therethrough; and a compressed gas discharge conduit having one end in fluid communication with said high pressure chamber portion and a second end inserted in said second end of said oil feeding tube with a gap defined between said compressed gas discharge conduit second end and said oil feeding tube second end, whereby oil enters said oil feeding tube through said gap and is induced by compressed gas from said compressed gas discharge conduit to flow through said oil feeding tube to be cooled and return to said plenum.

2. The rotary compressor of claim 1 wherein said compressed gas discharge conduit second end is coaxially inserted in said oil feeding tube second end, and wherein an outer diameter of said compressed gas discharge conduit second end has a diameter sufficiently smaller than an inner diameter of said oil feeding tube second end so as to form an annular space therebetween, said annular space comprising said gap.

3. The rotary compressor according to claim 1, wherein said rotary axis extends in the vertical direction.

* * * * *